US006702130B1

(12) United States Patent
Carlilse

(10) Patent No.: US 6,702,130 B1
(45) Date of Patent: Mar. 9, 2004

(54) DOOR PAINTING RACK

(76) Inventor: James Donnie Carlilse, 10596 County Rd. 99, Lillian, AL (US) 36549

( * ) Notice: Subject to any disclaimer, the term of this patent is extended or adjusted under 35 U.S.C. 154(b) by 0 days.

(21) Appl. No.: 09/898,668

(22) Filed: Jul. 2, 2001

(51) Int. Cl.[7] ..... A47B 47/00

(52) U.S. Cl. ..... 211/204; 248/125.8; 118/500; 211/175; 269/905; 269/208; 269/53

(58) Field of Search ..... 211/204, 162, 211/206, 424, 169, 165, 169.1, 163, 105.1–105.6, 170, 171, 172, 173, 175; 248/131, 145, 122.1, 125.8, 309.2; 118/500, 502, 503, 504; 269/54.2, 54.3, 54.1, 54.4, 54.5, 53, 905, 238, 208, 254 R; 403/325, 322.1; 16/229, 230

(56) References Cited

U.S. PATENT DOCUMENTS 930,129 A * 8/1909 Bausejour et al. ..... 118/500
1,564,668 A * 12/1925 Hageman ..... 16/229
2,923,417 A * 2/1960 Sonksen ..... 211/123
3,584,351 A * 6/1971 Sliwinski ..... 24/239
3,625,368 A * 12/1971 Toms ..... 211/51
4,278,244 A * 7/1981 Carter ..... 269/17
4,934,015 A * 6/1990 Mink ..... 211/123
5,164,011 A 11/1992 Ray ..... 118/500
5,503,278 A * 4/1996 Ishmael ..... 211/169
5,617,962 A * 4/1997 Chen ..... 211/206
5,660,637 A * 8/1997 Dodge ..... 118/500
5,894,945 A 4/1999 Curran ..... 211/162
6,158,701 A * 12/2000 Deshler ..... 248/127
6,205,616 B1 * 3/2001 Hwang ..... 16/229
6,286,692 B1 * 9/2001 Hemping ..... 211/169
6,327,949 B1 * 12/2001 Abernathy ..... 83/452
6,338,758 B1 * 1/2002 Curran ..... 118/500

* cited by examiner

*Primary Examiner*—Daniel P. Stodola
*Assistant Examiner*—Jennifer E. Novosad
(74) *Attorney, Agent, or Firm*—Peter Loffler

(57) ABSTRACT

A door painting rack holds one or more doors for finishing by a painter. A base member has a lower support pin and a stop while an extension extends upwardly from the base member. An extension arm extends outwardly in fixed fashion from the extension arm and has a spring-loaded upper support pin located thereon, the upper support pin facing and aligned with the lower support pin. A door is positioned between the two support pins. A portion of the base member, the extension arm, and the extension support may each be telescoping in appropriate fashion.

19 Claims, 7 Drawing Sheets

DOOR PAINTING RACK

BACKGROUND OF THE INVENTION

1. Field of the Invention

The present invention relates to a rack for holding doors that are painted while held by the rack.

2. Background of the Prior Art

During new construction, such as a house or office complex, a few doors to many dozen doors will need to be painted or otherwise finished. Typically, each door is finished prior to being installed within the opening which the door will serve. One method of door finishing commonly employed is to rest the door on one of its surfaces and finish the opposing surface. After the surface is painted, the door is flipped and the unfinished surface of the door is then finished. The problem with such a method is that it is time-consuming and requires excessive handling of the door. Additionally, as the door is generally slanted during the finishing process, excess paint or other finish can tend to collect in a particular location resulting in an uneven finish.

In order to address such problems, door painting racks have been proposed wherein the door is hung from a rack and is completely finished while held within the rack. While such prior art devices work with varying degrees of efficiency, they tend to suffer from one or more drawbacks.

Many door painting racks are unusually complex in design and construction, making the racks expensive to manufacture and time-consuming to assemble and use. Other devices have limited functionality, thereby making such racks of limited value to a painter.

Therefore, there exists a need in the art for a door painting rack that allows for relatively quick and easy finishing of a large number of doors. Such a rack must not be unusually complex in design and construction, so that the rack is relatively inexpensive to manufacture and is quick and easy to assemble and use. The rack must be versatile for use with a wide variety of doors and in various settings.

SUMMARY OF THE INVENTION

The door painting rack of the present invention addresses the aforementioned needs in the art. The door painting rack allows a painter to finish a large number of doors quickly and easily. The rack is relatively simple in design and construction, so that the rack is relatively inexpensive to manufacture and is quick and easy to assemble and use. The rack can be used with a wide variety of doors and can be used a variety of settings.

The door painting rack of the present invention is comprised of a base member having a first lower support pin attached thereto. An extension support extends upwardly from the base member while a first extension arm extends outwardly from the extension support. A first spring-loaded upper support pin is attached to the first extension arm and faces the first lower support pin. The base member can be comprised of a first leg and a second leg that extends outwardly from the first leg and is generally parallel with the extension arm such that the first lower support pin is attached to the second leg. The second leg may be telescopic. A third leg extends outwardly from the first leg in opposing direction relative to the second leg. The third leg can be telescoping. A second lower support pin can be attached to the third leg while a second extension arm extends outwardly from the extension support in opposing direction relative to the first extension arm. A second spring-loaded upper support pin is attached to the second extension arm and faces the second lower support pin. A first stop is attached to the second leg while a second stop is attached to the third leg. The first extension arm is fixedly attached to the extension support and the second extension arm is fixedly attached to the extension support. The extension support may be telescoping.

BRIEF DESCRIPTION OF THE DRAWINGS

Similar reference numerals refer to similar parts throughout the several views of the drawings.

DESCRIPTION OF THE PREFERRED EMBODIMENT

Figure 1:
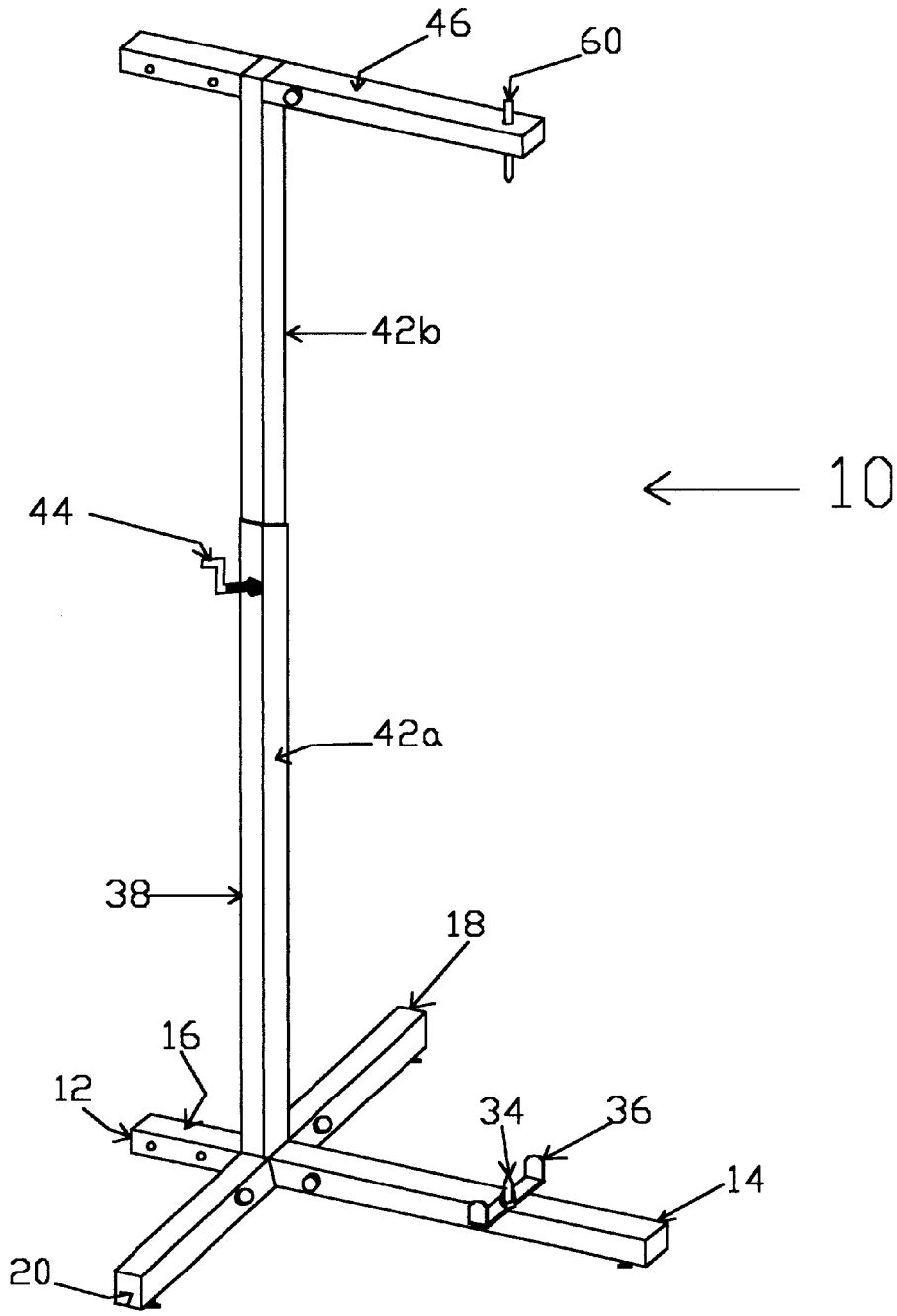
FIG. 1 is a perspective view of the door painting rack of the present invention configured to hold a single door.
Figure 2:
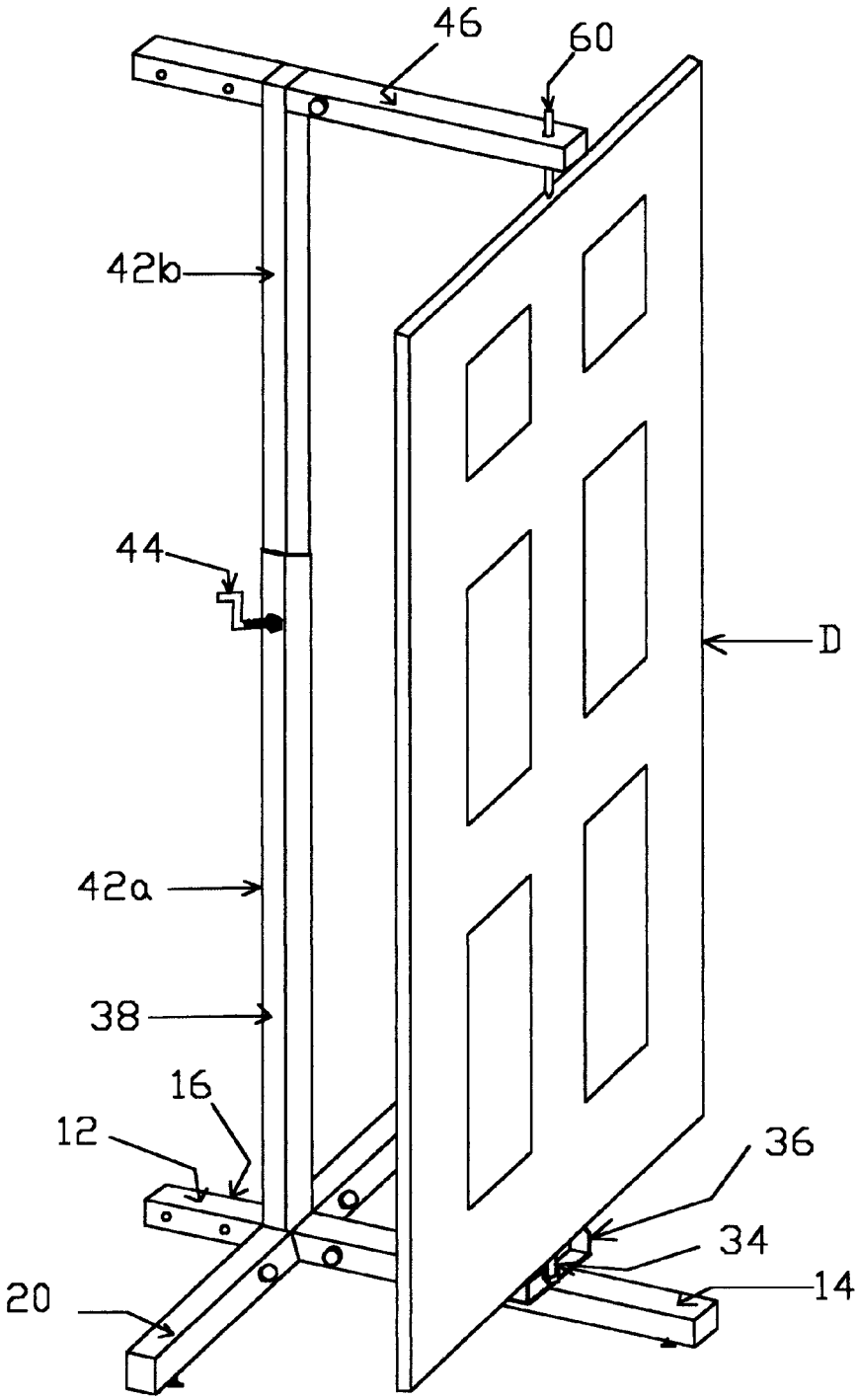
FIG. 2 is an environmental view of FIG. 1, with the door painting rack holding a door.

Referring now to the drawings, it is seen that the door painting rack of the present invention, generally denoted by reference numeral 10, is comprised of a base member 12. The base 12 can have any desired configuration such as the illustrated leg configuration wherein a plurality of legs extend outwardly from a central point. The illustrated base member 12 has a first leg 14 and a second leg 16 extend outwardly from a point in generally opposing directions (the first leg 14 and the second leg 16 can be viewed as a single long leg) while a third leg 18 and a fourth leg 20 (which can also be viewed as a single long leg) extend outwardly from the joinder point of the first leg 14 and the second leg 16, or from any other point along either the first leg 14, the second leg 16 or both. Various other leg configurations as well as other base member 12 configurations (a single flat base member 12, for example) are possible in keeping within the scope and spirit of the present invention 10, In a leg-based base member 12 configuration, the base member 12 can be a single unit, or as seen, the base member 12 can be a single sub-base frame member 22 onto which each of the various legs 14, 16, 18, and 20 are removably attached. Attachment of each leg to the sub-base frame member 22 can be accomplished in any standard fashion such as by providing openings 24 on the particular leg which openings 24 are aligned with openings 26 on a section of the sub-base frame member 22 and a pin 28 is passed through the aligned openings 24 and 26. If desired, a washer 30 can be affixed to the pin 28 and a cotter pin 32 can be passed through the pin 28 so that the pin 28 is not easily removed. By providing more than one set of openings 24 on the particular leg (or on the sub-base frame member 22) that particular leg becomes telescoping, although only working legs—legs that receive a door D thereon—need to be made telescoping. An advantage of having removable legs attachable to a sub-frame 22 is that it allows the door painting rack 10 to be disassembled for ease in transport and storage.

Figure 3:
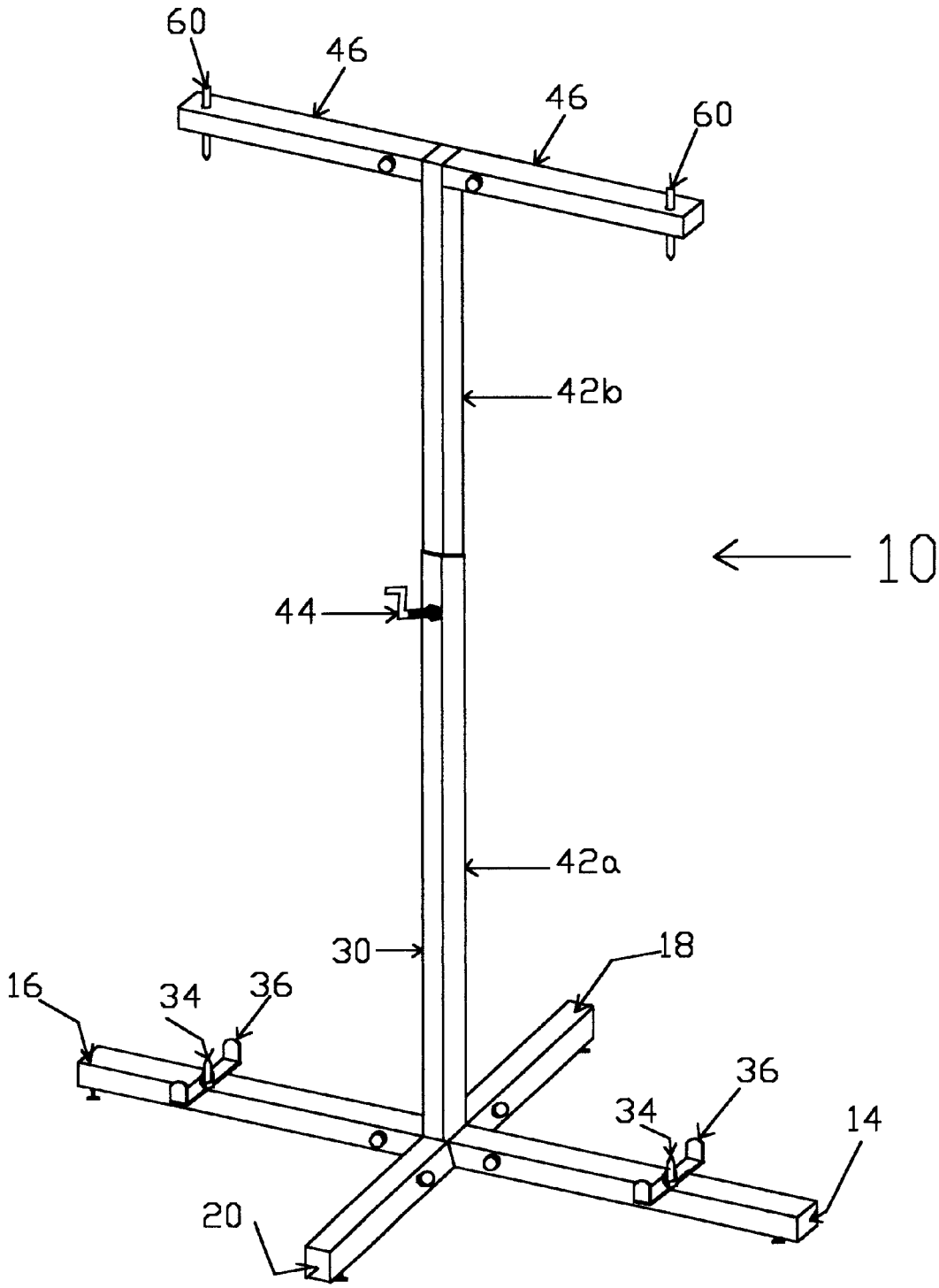
FIG. 3 is a perspective view of the door painting rack of the present invention configured to hold more than one door.
Figure 4:
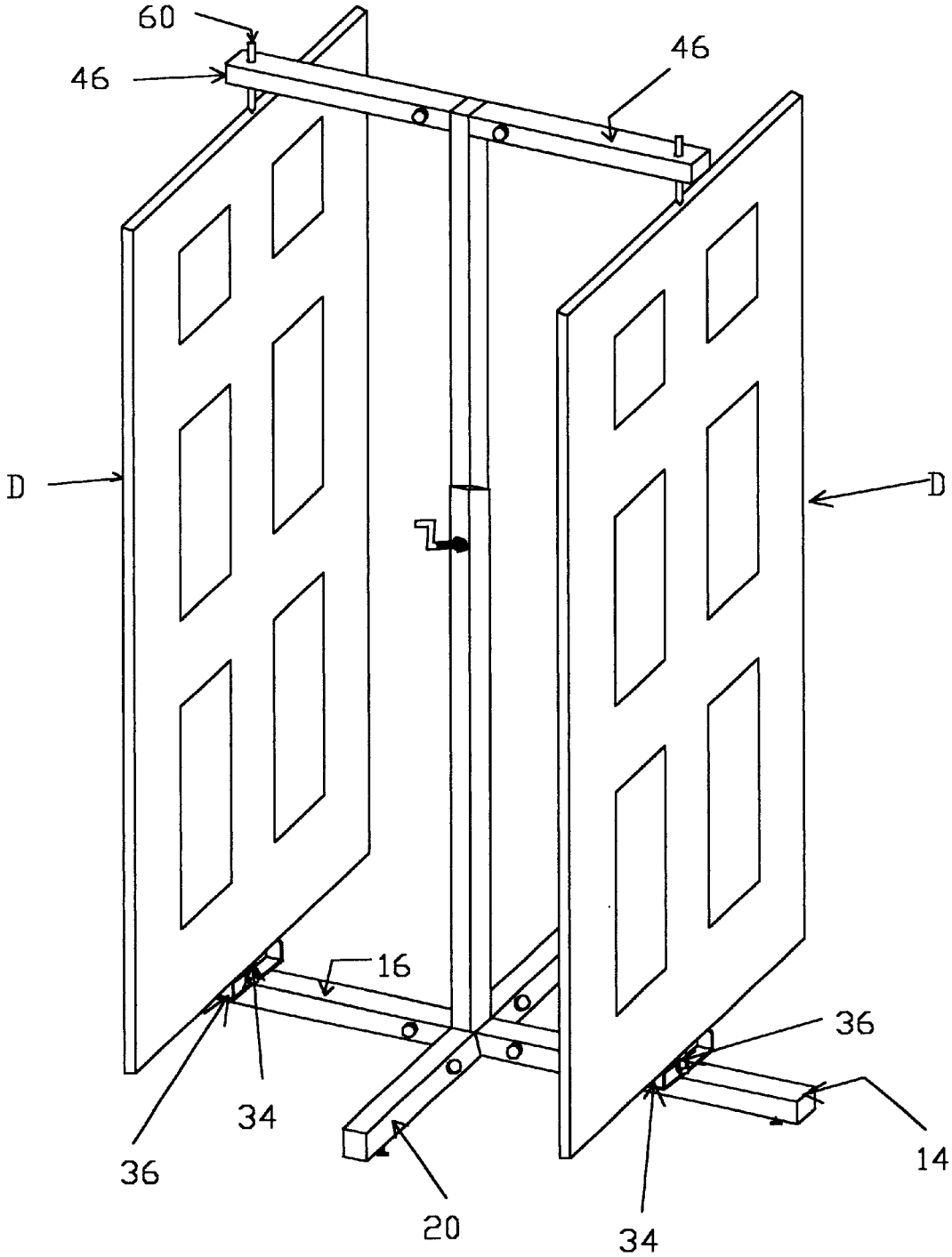
FIG. 4 is an environmental view of FIG. 3, with the door painting rack holding a pair of doors.
Figure 5:
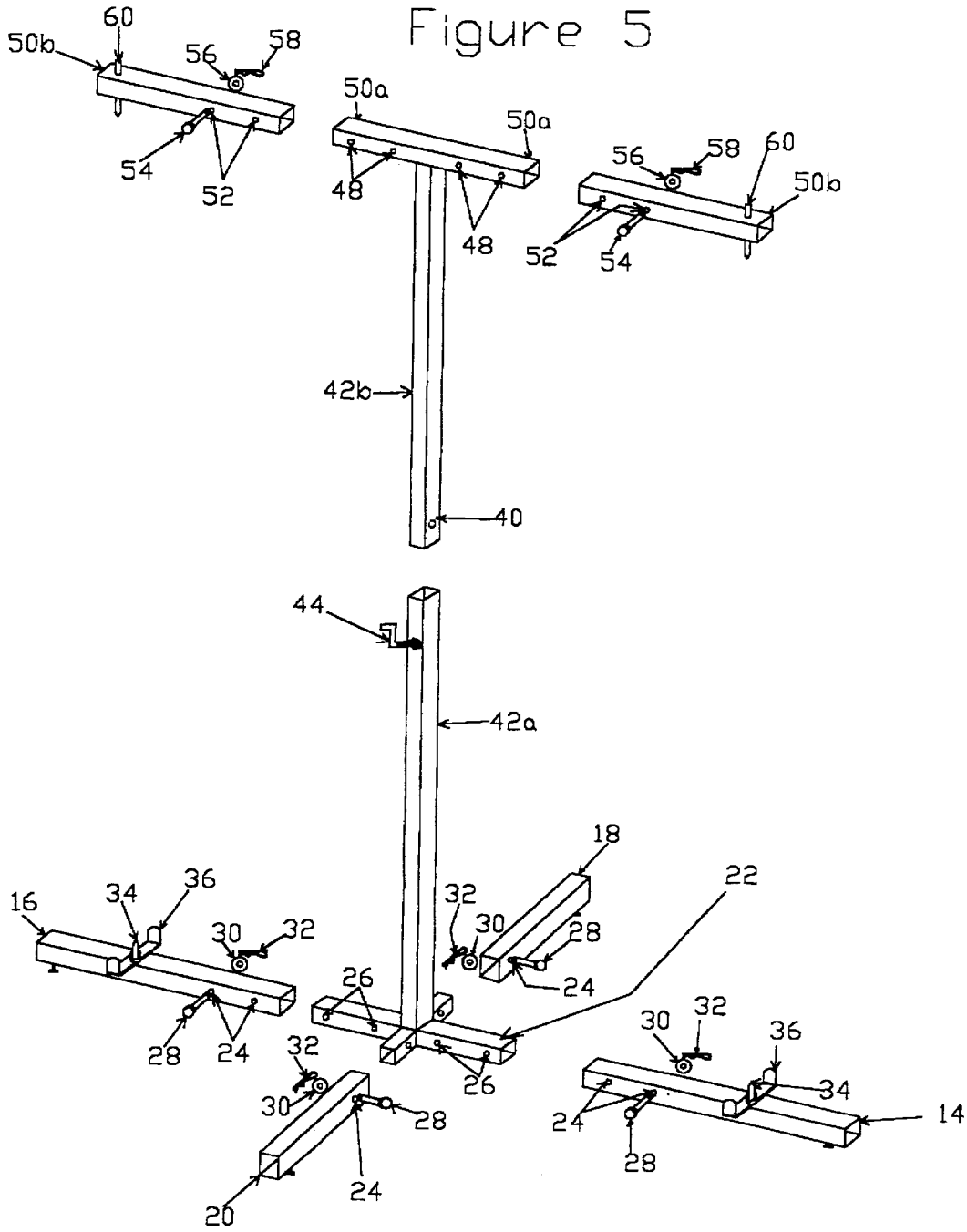
FIG. 5 is a partially exploded view of the door painting rack of the present invention.
Figure 6:
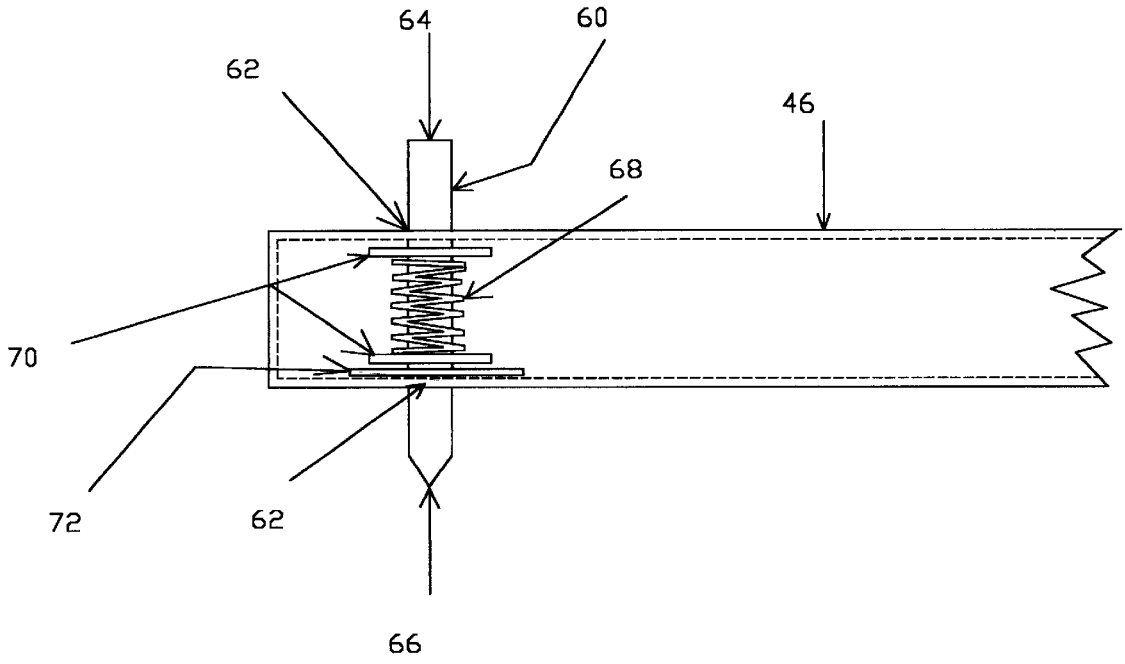
FIG. 6 is a partially sectioned view of the upper support pin used with the door painting rack of the present invention.
Figure 7:
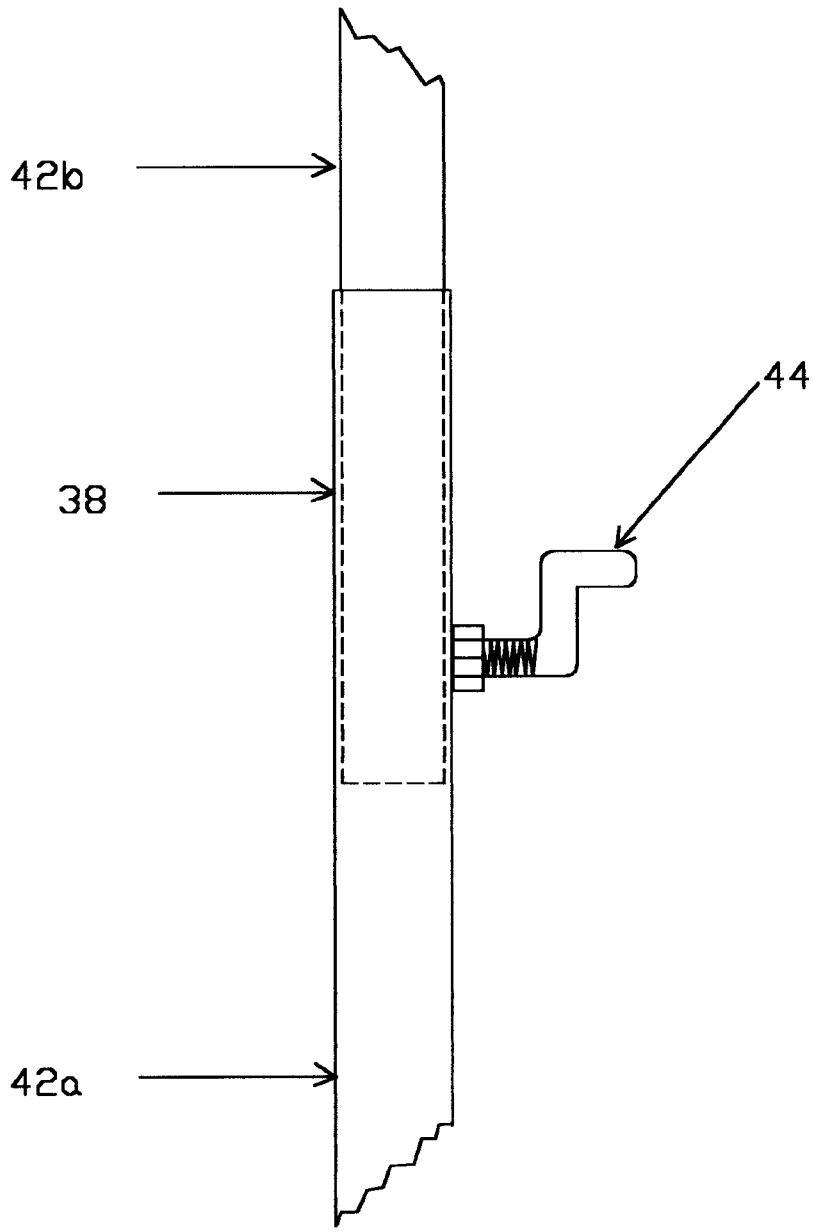
FIG. 7 is a close-up view of the height adjustment mechanism used with the extension support of the door painting rack of the present invention.

A lower support pin 34 is attached to the base member 12 at any desired location. If the door painting rack 10 is configured to receive more than one door D, then, one or more additional lower support pins 34 will be located on legs other than the leg to which the first lower support pin 34 is attached. If the leg configuration illustrated in FIGS. 3–5 is used, then a lower support pin 34 will be located on the first leg 14 and the opposing second leg 16. If a multiple door holding configuration is desired, for example a four door configuration, then a lower support pin 34 will be located on each of the four legs 14, 15, 18, and 20. A stop 36 will be located on the base member 12, one stop 36 for each lower support pin 34 that is located on the base member 12.

An extension support 38 extends upwardly from the base member 12. The extension support 38 may be either of fixed height or may be telescoping in any desired fashion such by providing an opening 40 on one of the sections 42*a* of the extension support 38 and providing an adjustment handle 44 that is threadably secured to this section 42*a* and that friction engages with the other section 42*b* of the extension support 38. In order to adjust the height of the extension support 38, the two sections 42*a* and 42*b* are positioned relative to one another to the desired height and the adjustment handle 44 is rotated until it engages the second section 42*b* of the extension support 38 and thereby friction holds the two sections 42*a* and 42*b* relative to one another. If a different height is desired, the adjustment handle 44 is counterrotated in order to disengage from the second section 42*b*, the two sections 42*a* and 42*b* are repositioned, and the handle 44 is again rotated in order to once again engage the second section 42*b*.

A first extension arm 46 extends outwardly from the extension support 38 and is secured to the extension support 38 in fixed fashion. If the door painting rack 10 is configured to hold more than one door D, additional extension arms 46 are provided, one extension arm 46 for each door D that the device 10 is designed to hold at one time. If the legs of the base member 12 are telescoping, then each extension arm 46 is telescoping to correspond with its respective leg. The telescoping nature of each extension arm 46 is accomplished in any desired fashion such as by providing a pair of openings 48 on a first section 50*a* of the extension arm 46 and providing a series of opening pairs 52 on a second section 50*b* of the extension arm 46 and aligning the openings 48 on the first section 50*a* with a pair of openings 52 on the second section 50*b* and passing a pin 54 through the aligned openings 48 and 52. A washer 56 may be placed on the pin 54 while a cotter pin 58 may be passed through the pin 54 in order to hold the pin 54 in position.

A spring-loaded upper support pin 60 is attached to the each extension arm 46 and aligns with and faces the lower support pin 34 found on the base member 12. The upper support pin 60 passes through corresponding openings 62 located on the extension arm 46 and has a shaft 64, and a head portion 66. The shaft 64 slides through the openings 62, while a compression spring 68 biases the shaft 64 in a downward orientation. The spring 68 is located within the extension arm 46 and abuts the upper inner surface and the lower inner surface of the extension arm 46, with washers 70 disposed between the ends of the spring 68 and the respective inner surfaces and of the extension arm 46. A cotter pin 72 is passed through the shaft 64 under washer 70 and prevent the shaft 64 from being overextended through the openings 62.

in order to use the door painting rack 10 of the present invention, the extension support 38 is adjusted to the desired height to accommodate the size of the door D to be held by the device 10. Each leg that is to support a door D is adjusted to its desired length (if telescopic) and the corresponding extension arm 46 is also adjusted to a corresponding length so that the lower support pin 34 and the upper support pin 60 are vertically aligned. A door D is positioned within the door painting rack 10 by pushing on the upper support pin 60 upwardly causing the upper support pin 60 to move upwardly. The door D is then rested on the lower support pin 34 and the spring 68 of the upper support pin 60 biases the upper support pin 60 on the door D thereby holding the door D in position within the device 10. The stop 36 located on the base member 12 prevents rotation of the door D. The door D is now ready to be finished in desired fashion. In order to remove the door D from the door painting rack 10, the door D is lifted upwardly causing the upper support pin 60 to move upwardly. Once the door D is clear of the lower support pin 34, the door D is removed from the device 10.

For transport of the device 10, the various components are disassembled, and the device 10 is transported and reassembled at the next location.

While the invention has been particularly shown and described with reference to an embodiment thereof, it will be appreciated by those skilled in the art that various changes in form and detail may be made without departing from the spirit and scope of the invention.

I claim:

1. A rack for supporting an article having opposed large side surfaces interconnected by narrow opposed edges during coating thereof, the rack comprising:

a base member wherein the base member comprises a first leg and a telescopic second leg that extends outwardly from the first leg and is generally parallel with a first extension arm and a first lower support pin is attached to the second leg;

an extension support extending upwardly from the base member;

the first extension arm extending outwardly from the extension support, the first extension arm being oriented in generally perpendicular fashion to the extension support and being so fixed;

a first spring-loaded upper support pin attached to the first extension arm and facing the first lower support pin; and wherein the first upper support pin and first lower support pin are adapted to engage opposed edges of the article and hold the article therebetween.

2. The rack as in claim 1 further comprising a third leg extending outwardly from the first leg in opposing direction relative to the second leg.

3. The rack as in claim 2 wherein the third leg is telescopic.

4. The rack as in claim 2 further comprising:

a second lower support pin attached to the third leg;

a second extension arm extending outwardly from extension support in opposing direction relative to the first extension arm; and a second spring-loaded upper support pin attached to the second extension arm and facing the second lower support pin.

5. The rack as in claim 4 further comprising:

a first stop attached to the second leg; and a second stop attached to the third leg.

6. The rack as in claim 4 wherein the second extension arm is fixedly attached to the extension support.

7. The rack as in claim 1 further comprising a stop attached to the base member.

8. The rack as in claim 1 wherein the extension support is telescoping.

9. A rack for supporting an article having opposed large side surfaces interconnected by narrow opposed edges during coating thereof, the rack comprising:

a base member having a first leg and at least one second leg;

an extension support extending upwardly from the base member;

a first extension arm extending outwardly from the extension support, the first extension arm being oriented in generally parallel fashion to the first leg and being so fixed;

a first lower support pin attached to the first leg;

a first spring-loaded upper support pin attached to the first extension arm and facing the first lower support pin;

a second lower support pin attached to the first leg in spaced apart fashion to the first lower support pin;

a second extension arm extending outwardly from the extension support in opposing direction relative to the first extension arm, the second extension arm being oriented in generally parallel fashion to the first leg and being so fixed;

a second spring-loaded upper support pin attached to the second extension arm and facing the second lower support pin; and wherein either the first upper support pin and first lower support pin or the second upper support pin and the second lower support pin are adapted to engage opposed edges of the article and hold the article therebetween.

10. The rack as in claim 9 further comprising:

a first stop attached to the first leg; and a second stop attached to the first leg in spaced apart fashion to the first stop.

11. The rack as in claim 9 wherein the first leg is telescoping in a first direction.

12. The rack as in claim 11 wherein the first leg is telescoping in a second direction.

13. The rack as in claim 9 wherein the extension support is telescoping.

14. A rack for supporting an article having opposed large side surfaces interconnected by narrow opposed edges during coating thereof, the rack comprising:

a base member wherein the base member comprises a first leg, a second leg that extends outwardly from the first leg and is generally parallel with a first extension arm and a first lower support pin is attached to the second leg, and a telescoping third leg that extends outwardly from the first leg in opposing direction relative to the second leg;

an extension support extending upwardly from the base member;

the first extension arm extending outwardly from the extension support, the first extension arm being oriented in generally perpendicular fashion to the extension support and being so fixed;

a first spring-loaded upper support pin attached to the first extension arm and facing the first lower support pin; and wherein the first upper support pin and first lower support pin are adapted to engage opposed edges of the article and hold the article therebetween.

15. The rack as in claim 14 further comprising:

a second lower support pin attached to the third leg;

second extension arm extending outwardly from the extension support in opposing direction relative to the first extension arm; and a second spring-loaded upper support pin attached to the second extension aim and facing the second lower support pin.

16. The rack as in claim 15 further comprising:

a first stop attached to the second leg; and a second stop attached to the third leg.

17. The rack as in claim 15 wherein the second extension aim is fixedly attached to the extension support.

18. The rack as in claim 14 further comprising a stop attached to the base member.

19. The rack as in claim 14 wherein the extension support is telescoping.

* * * * *